US009457460B2

(12) United States Patent
Hermansen et al.

(10) Patent No.: US 9,457,460 B2
(45) Date of Patent: Oct. 4, 2016

(54) MULTIPLE TOOL

(75) Inventors: Frank Hermansen, Laguna Beach, CA (US); Carl Winefordner, Laguna Beach, CA (US)

(73) Assignee: Crank Brothers, Inc., Laguna Beach, CA (US)

( * ) Notice: Subject to any disclaimer, the term of this patent is extended or adjusted under 35 U.S.C. 154(b) by 253 days.

(21) Appl. No.: 14/238,720

(22) PCT Filed: Sep. 15, 2011

(86) PCT No.: PCT/IB2011/054037

§ 371 (c)(1),
(2), (4) Date: Feb. 12, 2014

(87) PCT Pub. No.: WO2013/038232

PCT Pub. Date: Mar. 21, 2013

(65) Prior Publication Data

US 2014/0165293 A1 Jun. 19, 2014

(51) Int. Cl.

| | |
|---|---|
| ***B25F 1/02*** | (2006.01) |
| ***B25G 1/08*** | (2006.01) |
| ***B25H 3/00*** | (2006.01) |
| ***B25B 13/56*** | (2006.01) |
| ***B25B 27/00*** | (2006.01) |

(52) U.S. Cl.

CPC ..... *B25F 1/02* (2013.01); *B25B 13/56* (2013.01); *B25B 27/0071* (2013.01); *B25G 1/085* (2013.01); *B25H 3/003* (2013.01)

(58) Field of Classification Search

CPC ..... B25F 1/003; B25F 1/02; B25B 13/56; B25B 27/0071; B25G 1/08; B25G 1/085; B25H 3/003

USPC ..... 81/440; 7/138, 168

See application file for complete search history.

(56) References Cited

U.S. PATENT DOCUMENTS

| | | | | |
|---|---|---|---|---|
| 5,711,042 | A * | 1/1998 | Chuang | B25B 13/56 157/1.3 |
| 5,918,513 | A | 7/1999 | Ho | |
| 5,927,164 | A | 7/1999 | Anderson et al. | |
| 6,050,409 | A | 4/2000 | Delbeck et al. | |
| 6,082,232 | A * | 7/2000 | Anderson | B25F 1/003 7/118 |
| 6,640,675 | B1 | 11/2003 | Chuang | |
| 6,983,506 | B1 * | 1/2006 | Brown | B25F 1/003 7/118 |

(Continued)

FOREIGN PATENT DOCUMENTS

| | | | |
|---|---|---|---|
| DE | 29715023 | U1 | 11/1997 |
| EP | 0776737 | A1 | 11/1996 |
| WO | WO2009010170 | A1 | 1/2009 |

OTHER PUBLICATIONS

PCT/IB2011/054037 International Search Report and Written Opinion, dated Mar. 18, 2014; 10 pages.

*Primary Examiner* — Hadi Shakeri
(74) *Attorney, Agent, or Firm* — Haynes and Boone, LLP

(57) ABSTRACT

A Multiple tool comprising a frame (2;102;202;302) supporting at least an holder (3;103;203;303) provided with a plurality of seats (4;104;204;304) for a respective plurality of implements (5;105;205;305), the holder (3;103;203;303) being selectively rotatable from an inactive position of minimum encumbrance to at least an opened position for the selection of an implement (5;105;205;305), and the frame (2;102;202;302) comprising an hexagonal recess (6;106;206;306) suitable for manually operate each of said implements (5;105;205;305).

17 Claims, 14 Drawing Sheets

(56) References Cited

U.S. PATENT DOCUMENTS 8,413,556 B2 * 4/2013 Chuang ..... B25B 13/56
157/1.3

2001/0012754 A1 8/2001 Anderson et al.

2006/0016706 A1 * 1/2006 Chen ..... B25H 3/003
206/379

2007/0251355 A1 11/2007 Kao

* cited by examiner

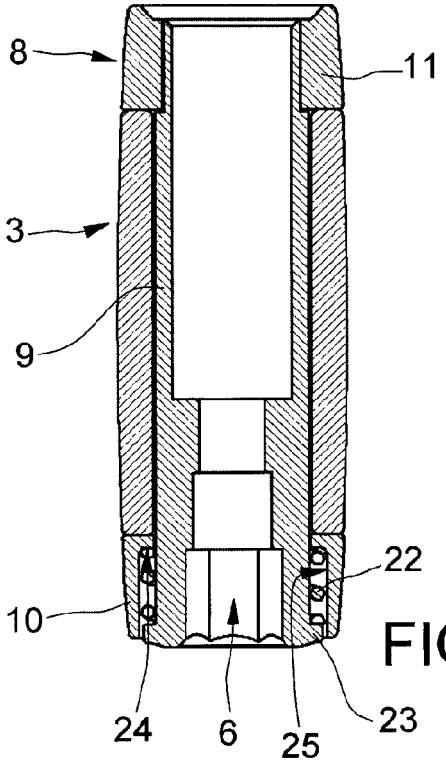
FIG. 11
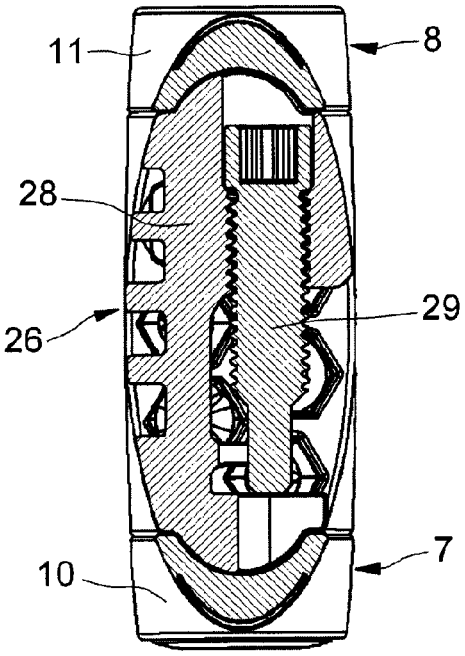
FIG. 12
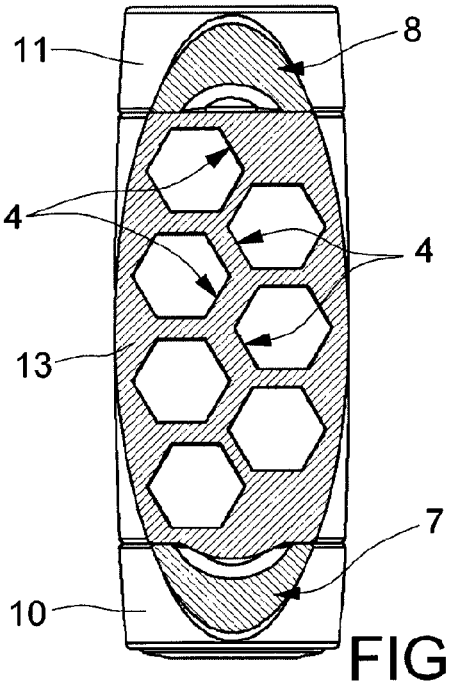
FIG. 13
FIG. 14
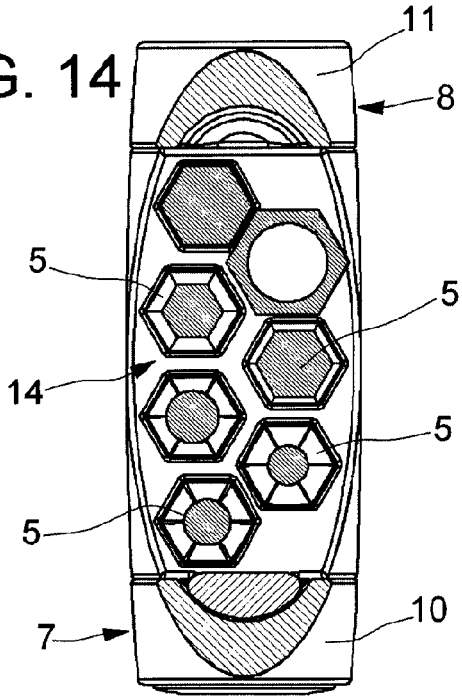

MULTIPLE TOOL

CROSS REFERENCE TO RELATED APPLICATIONS

This application is related to and claims the benefit of PCT Patent Application No. PCT/IB2011/054037, now publication No. WO 2013/038232 Al, filed on Sep. 15, 2011, which is incorporated herein by reference in its entirety.

TECHNICAL FIELD OF THE INVENTION

The present invention relates to a multiple tool. More specifically, this invention relates to a multiple tool for the maintenance and repair of motorcycles, cycles and the like, and their mechanical parts.

STATE OF THE ART

Multiple tools are known, particularly of the pocket type and then rather small, which allow the user to bring together in one portable object a number of implements, each one for a different use. Some examples of these implements are wrenches, allen keys, screwdrivers, and the like. Some known types of multiple tools are especially dedicated to the care, maintenance and repair of mechanical parts for cycles and motorcycles. The user can then bring with himself the multiple tool, for example, when making excursions or trips by bicycle or motorcycle, so he can work out emergency situations, such as mechanical damage to the medium, boring tire punctures, and more; alternatively, the multi-tool can be simply used to make quick adjustments on the medium itself, such as raise or lower the saddle, mount or dismount accessories, and so on.

Multiple tools of known type generally comprise a pivot around which said implements, adjacent one another, are rotatable from a minimum encumbrance retracted position to an operating position: this operating position is reached by manually rotating the implement around the pivot, starting from the retracted position, by a certain angle comfortable enough to use the implement by gripping the multi-tool.

In these multiple tools each implement, when used, is retained in the minimum encumbrance retracted position simply by friction; in other types of tools a case is used for containing the implements, and for preventing the implements from accidentally moving from the retracted position.

Either one or the other solution is not without drawbacks. The first solution is unable to ensure that implements are maintained in the retracted position; rather, they tend to rotate accidentally bothering the user, who often keep the multiple tool inside a shirt pocket, or in other pockets of sports clothing.

The second solution is cumbersome and impractical, since the user must, each time, remove the case from the multiple tool to be able to use it, and then store the same at the end of use: also it forces the user to take care of the case, not to lose it.

Multiple tools of known type also generally comprise implements that have an integrated loop to connect to the pivot. The loop is typically an integral part of the implement and is formed from bent or forged or investment cast steel. The loop portion of each implement adds significant weight and cost. Furthermore, because the loops vary in thickness for different tools and are usually different between different brands of tools, the user cannot easily customize the implements contained in the multiple tool without changing the length of the pivot. In other words, multiple tools of known type are essentially fixed with particular implements and without the user being able to easily customize the multiple tool to contain implements that most suit their particular needs.

Multiple tools of known type also generally comprise implements made in relatively small numbers, which makes the implements both more expensive to manufacture, and less readily available throughout the world if replacement is needed. Multiple tools that make use of hex driven standardized implements, which are of high production volume and low cost, are not designed in a way that is convenient or comfortable to carry in a pocket, either because of shape and/or being too big and/or by not maintaining minimum encumbrance in the retracted position.

Purposes of the Invention

The aim of the present invention is therefore to improve the state of the art, developing a multiple tool with more reliable, practical and safer use than the tools of the known type, in particular as to prevent effectively the various implements to accidentally move when not used, to reduce weight, to reduce cost of the tool, and to provide easy implement customization for each user.

This aim is achieved by the multiple tool according to the attached claim 1.

The implements are hex driven standardized tool bits readily and inexpensively available throughout much of the world. The standardized tool bits are made in such high volume that they are inexpensive. These tool bits have a ¼ inch hex drive and are used so commonly with various hand and motorized drivers that the variety of tool tips is extremely wide. For example, these tool tips are readily available in nearly all screw driver tip types and sizes, torx drives, hex drives, square drives, and many others. A driver to drive the tool bits is built into at least one of the two fasteners that hold the frame together. A magnet inside the fastener causes a tool bit to be conveniently held inside the driver recess of the fastener.

The presence of elastic retention means in the multiple tool according to the present invention allows maintaining all implements, when not used, in the respective minimum encumbrance position in a stable and secure way; furthermore, said elastic retention means permit, at the same time, to bring each implement simply and easily from the minimum encumbrance position to open positions, held in the open position by friction, for selection of an implement. A chain breaker is secured between the frames by the elastic retention means, as well. The chain breaker also has notches that act as wheel spoke wrenches. For cost and weight reasons, preferably, the holders are made of a low density and inexpensive material such as injection molded nylon, the frames out of a forged metal such as aluminum, and the fasteners out of steel.

Further advantageous features are described in the dependent claims.

BRIEF DESCRIPTION OF THE DRAWINGS

These and other advantages will be better understood by any man skilled in the art from the following description that follows and from the attached drawings, given as a non-limiting example, in which:

FIG. 11 is a section of the multiple tool according to plane XI-XI of FIG. 5;

FIG. 12 is a section of the multiple tool according to plane XII-XII of FIG. 5;

FIG. 13 is a section of the multiple tool according to plane XIII-XIII of FIG. 5;

FIG. 14 is a section of the multiple tool according to plane XIV-XIV of FIG. 5;

FIG. 18 FIG. 8 is an exploded perspective view of another embodiment the multiple tool;

EMBODIMENTS OF THE INVENTION

Figure 1:
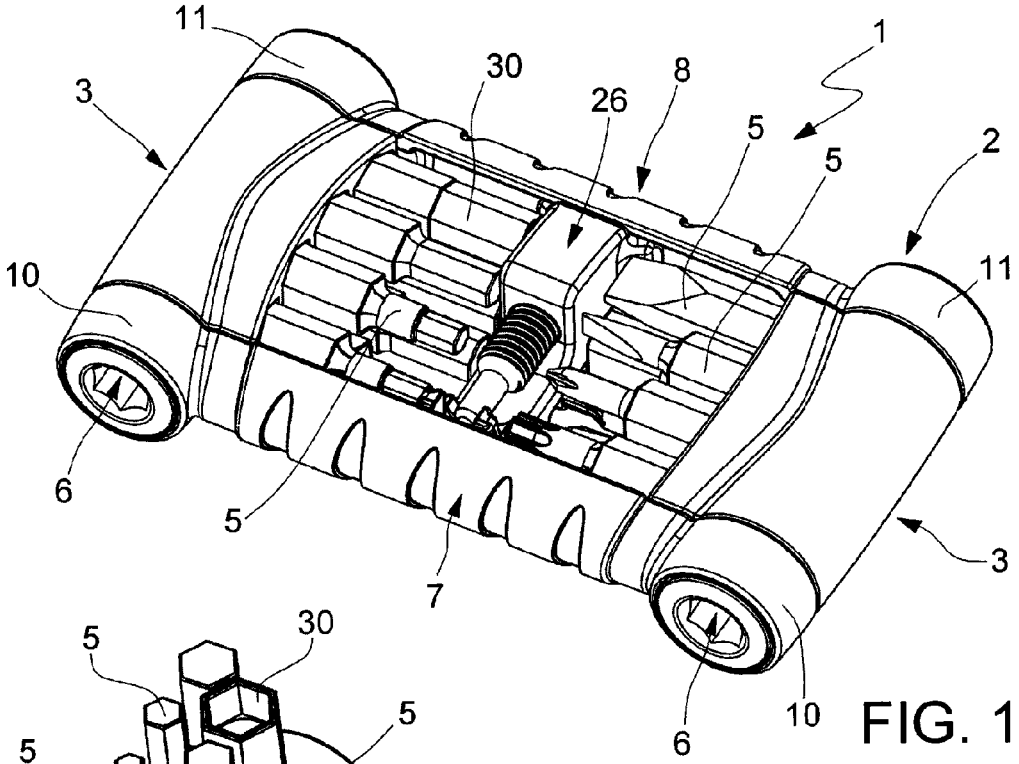
FIG. 1 is a perspective view of the multiple tool according to the invention.

With reference to the schematic representation of FIG. 1, a multiple tool according to the invention is wholly indicated with 1.

In the following embodiments individual characteristics, given in connection with specific embodiments, may actually be interchanged with other different characteristics that exist in other embodiments.

The multiple tool according to the present invention, which will be described below in its embodiments, is directed, particularly but not exclusively, to be used by bicycles and motorcycles users and the like, to perform maintenance and repairs on them. Other uses of this multiple tool can be provided without any limitation for the aims of this invention.

The multiple tool 1 according to the embodiment shown in FIGS. 1-17 comprises a frame 2 supporting at least an holder 3 provided with a plurality of seats 4 for a respective plurality of implements 5.

Figure 2:
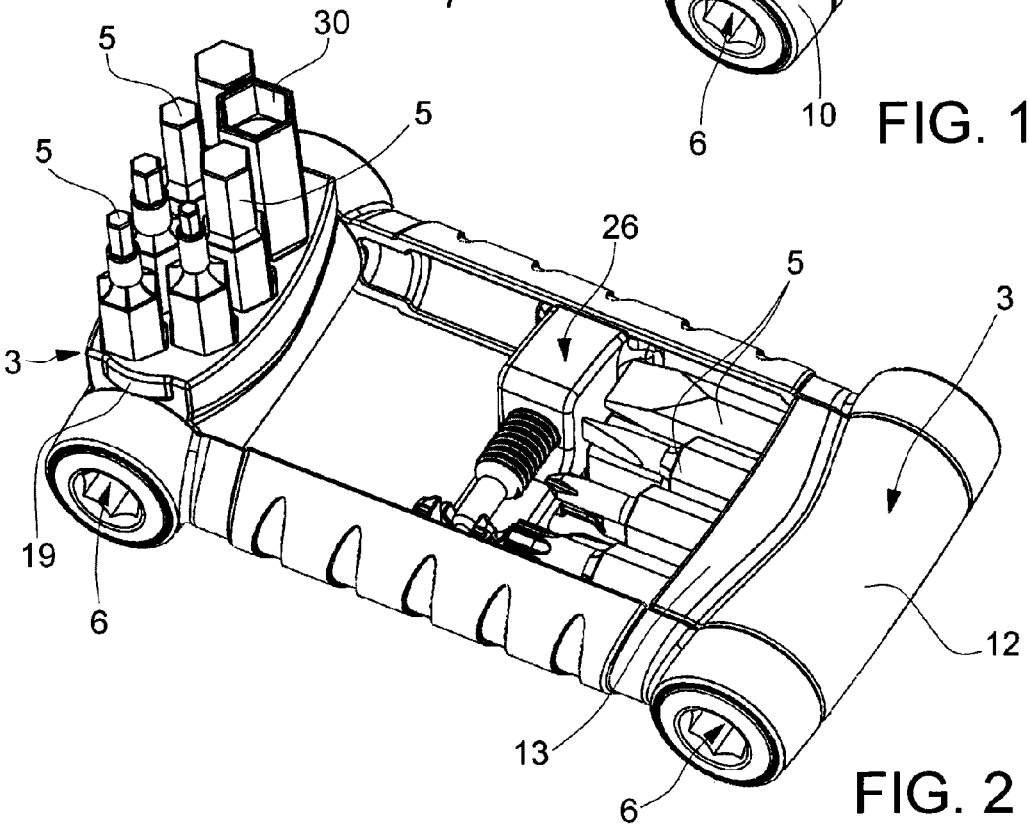
FIG. 2 is a perspective view of the multiple tool with one implement holder open for selection of an implement.

The holder 3 is selectively rotatable from an inactive position of minimum encumbrance, shown in FIG. 1, to at least an opened position for the selection of at least an implement 5, shown in FIG. 2.

More in detail, the multiple tool 1 comprises two holders 3, each having a plurality of seats 4 for a respective plurality of implements 5.

Figure 3:
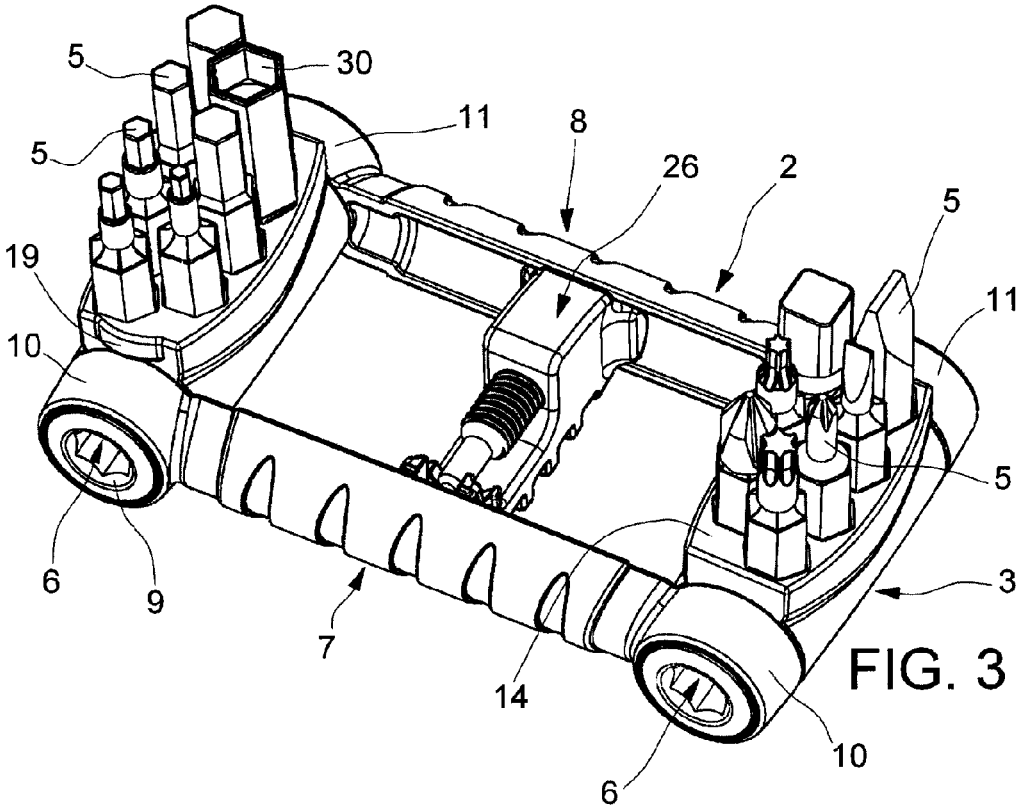
FIG. 3 is a perspective view of the multiple tool with both implement holders open for selection of an implement.

As shown in FIG. 3, each of the holders 3 is selectively rotatable, and independently from the other one, from an inactive position of minimum encumbrance to an opened position, for the selection of an implement 5.

According to another aspect of the present invention, the frame 2 of the multiple tool 1 further comprises driver means 6 suitable to manually operate each of the implements 5.

The frame 2 of the multiple tool 1 comprises a first elongated member 7 and a second elongated member 8, provided opposite to each other.

The first and second elongated members 7,8 are preferably forged or cast.

The external surface of the first and second elongated members 7,8 may be made of a soft or slightly coarse material, in order to facilitate handling and to prevent slipping out of hands during use.

The holders 3 are supported between the elongated members 7,8 in a rotatable way.

To achieve this effect, the multiple tool 1 comprises two pivot elements 9 for the respective two holders 3. The two pivot elements 9 connect the first elongated member 7 to the second elongated member 8, defining a substantially rectangular support structure.

Figure 7:
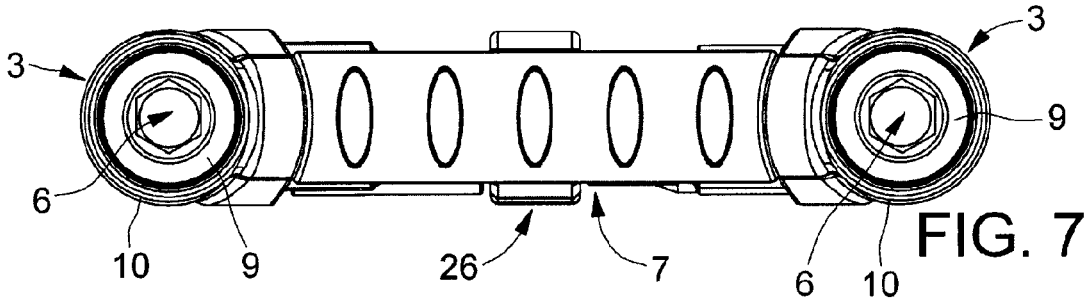
FIG. 7 is a side view of the multiple tool.

As clearly shown, for example, in FIG. 7, each of the first and second elongated members 7,8 has two respective extremities 10,11 having cylindrical shape. Each of the extremities 10,11 is provided with a passing hole, as described hereafter.

Figure 8:
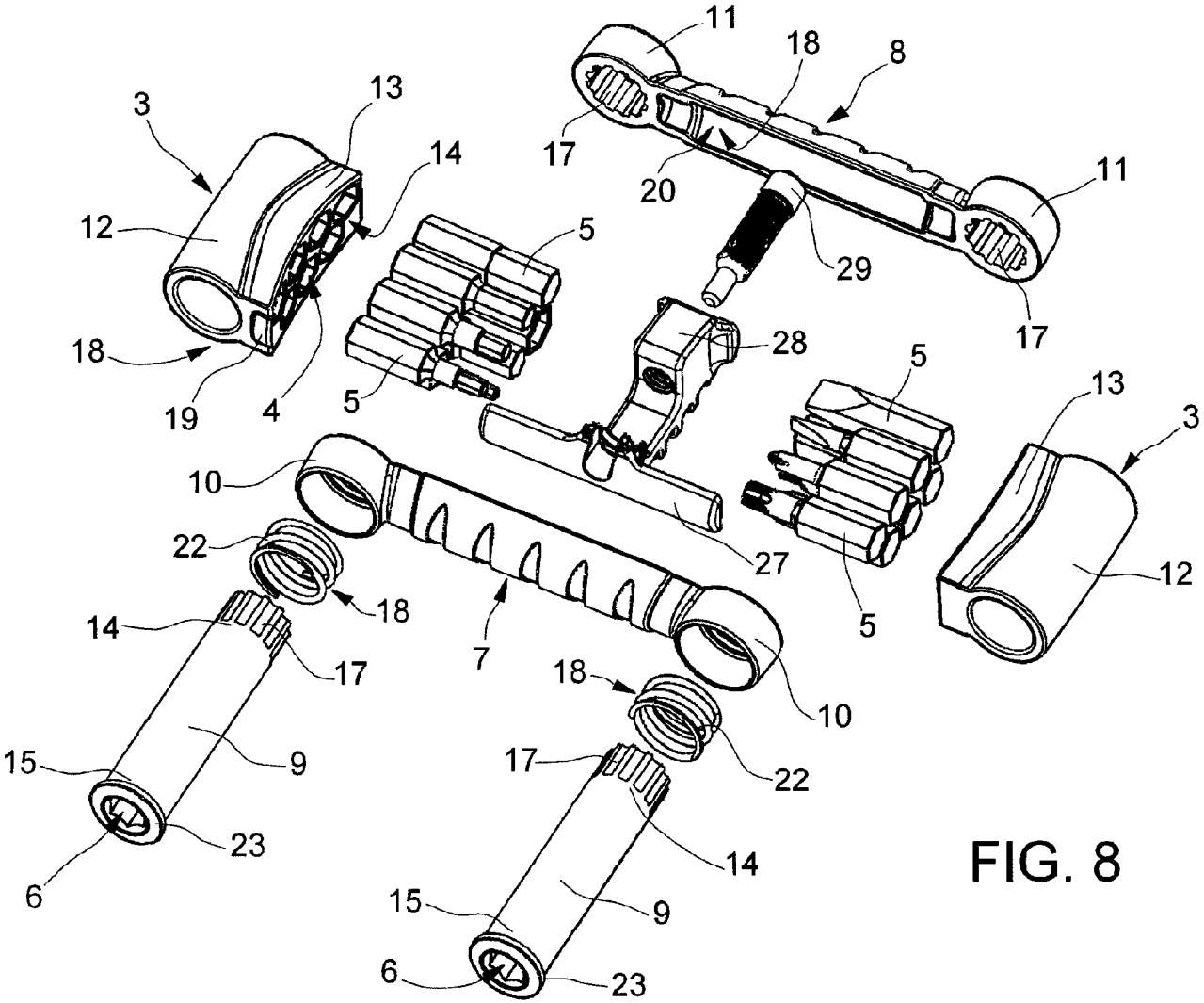
FIG. 8 is an exploded perspective view of the multiple tool.

Each of the holders 3, as shown for example in FIG. 8, comprises a bushing 12, inserted along the respective pivot element 9, and a radially protruding portion 13.

The radially protruding portion 13 comprises a surface 14 provided with the seats 4 for the implements 5.

Figure 9:
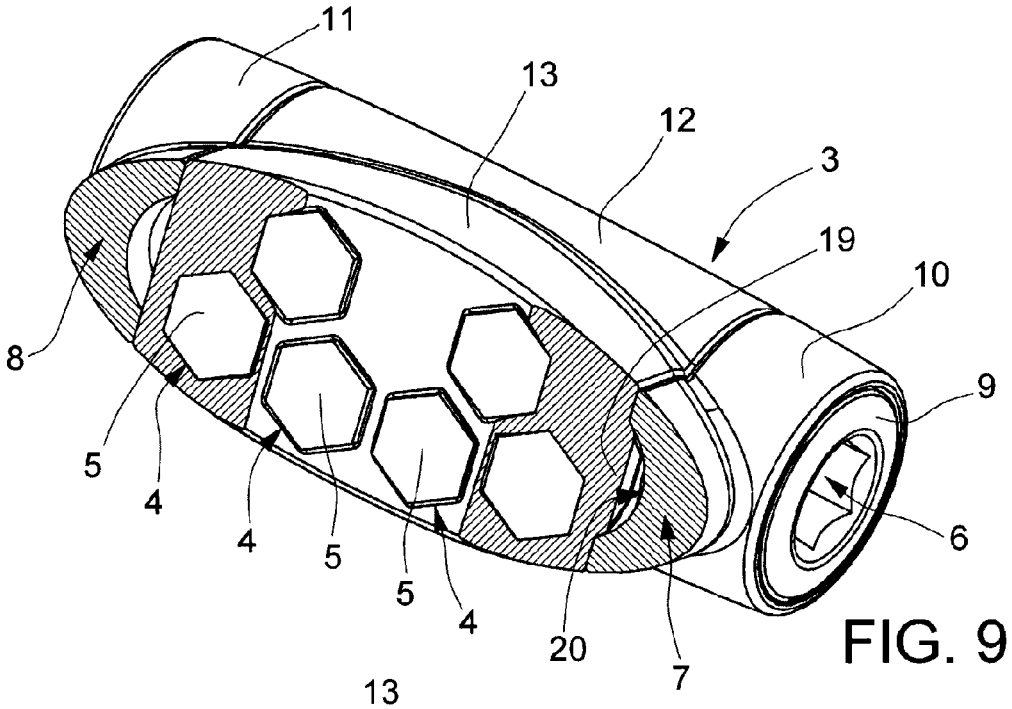
FIG. 9 is a perspective section view of the multiple tool.
Figure 10:
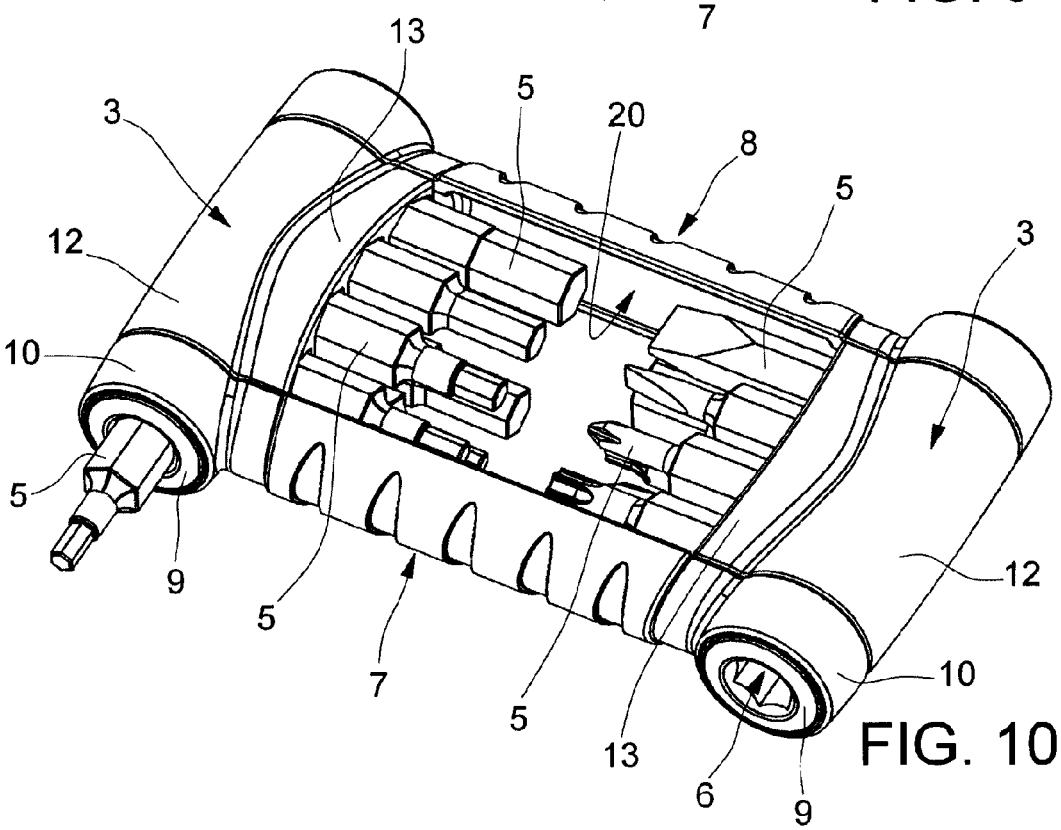
FIG. 10 is a perspective view of the multiple tool with one of the implements in an operating position.

In the embodiments described, the seats 4 have preferably an hexagonal cross section, as shown in FIGS. 9,13,14. However, the seats 4 could have any cross section or shape that an implement 5 could fit into, without limitations, for example they could have a round cross section or similar.

Consequently, the implements 5 are hexagonal driven standardized tool bits readily and inexpensively available throughout much of the world. These tool bits have, for example, a ¼ inch hexagonal drive and are readily available in nearly all screw driver tip types and sizes, torx drives, hex drives, square drives, and many others.

However, the implements 5 may be of any other kind available on the market or custom made, without any limitation. Consequently, the seats 4 may have any other shape fitting the kind of implements 5 used in the multiple tool 1.

Obviously, since the implements 5 are removably inserted in the seats 4, they may be replaced with other implements at user's discretion: the user is therefore free to customize its own multiple tool, in order to satisfy his personal needs.

The driver means 6 of the implements 5 stored in the holders 3 are provided by the extremities 10 of the first elongated member 7.

In other embodiments, not shown, of the present invention, the driver means 6 could be foreseen also in the second elongated member 8, without limitations. More in detail, the driver means 6 comprise, for each of the extremities 10 of the first elongated member 7, an hexagonal recess in which each implement 5 may be selectively inserted.

Each pivot element 9 is constituted by a cylindrical hollow body, in order to save weight, having a first end 14 and a second end 15.

However, each pivot element 9, or just one of them, could be partially solid.

Each pivot element 9 is preferably made by machining and broaching.

As shown in FIG. 8 and also in FIG. 11, the hexagonal recesses 6 are provided by the first end 15 of each pivot element 9.

Each second end 16 of each pivot element 9 is rigidly connected to the corresponding extremity 11 of the second elongated member 8, as shown in FIG. 11. More in particular, each second end 16 of each pivot element 9 is rigidly connected to the respective extremity 11 of the second elongated member 8 by means of spline profiles 17, to prevent turning.

Any other kind of connection suitable to prevent turning may be used between each second end 16 of each pivot element 9 and the second elongated member 8. According to another aspect of the present invention, the frame 2 of the multiple tool 1 comprises elastic retention means, wholly indicated with 18, of each of the holders 3 in the respective inactive position, and in the opened position, as clarified hereafter.

Thanks to these elastic retention means 18, the implements 5 are safely stored in the holders 3 in the inactive position.

Furthermore, when the user needs to select the implement 5 to be used, the holder 3 is firmly retained in an opened position, making the choice easier, even using just one hand.

The elastic retention means 18 comprise, for each holder 3, a bump 19 provided by at least a side of the radially protruding portion 13 of the holder 3 itself. The elastic retention means 18 further comprise a recess 20 provided in the inner face 21 of the first and second elongated members 7,8.

When each holder 3 is its respective inactive position, the respective bump 19 fits inside the corresponding recess 20 of the first elongated member 7 or of the second elongated member 8, as shown for example in FIG. 13.

In this way, the holder 3 is retained in the inactive position and cannot rotate around the pivot element 9 axis.

The elastic retention means 18 further comprise, for each pivot element 9, a compression spring 22—shown in FIGS. 8,11—interposed between the first end 15 of the pivot element 9 and the corresponding extremity 10 of the first elongated member 7.

More in detail, as shown in FIG. 11, the compression spring 22 rests between a terminal collar 23, provided in each first end 15 of each pivot element 9, and the bottom surface 24 of a cylindrical seat 25 provided in the corresponding extremity 10 of the first elongated member 7.

According to a further aspect of the present invention, the multiple tool 1 comprises a chain breaker tool, wholly indicated with 26, substantially of the known kind.

The chain breaker tool 26 is elastically held, in an inactive position of minimum encumbrance, between the first elongated member 7 and the second elongated member 8.

Figure 17:
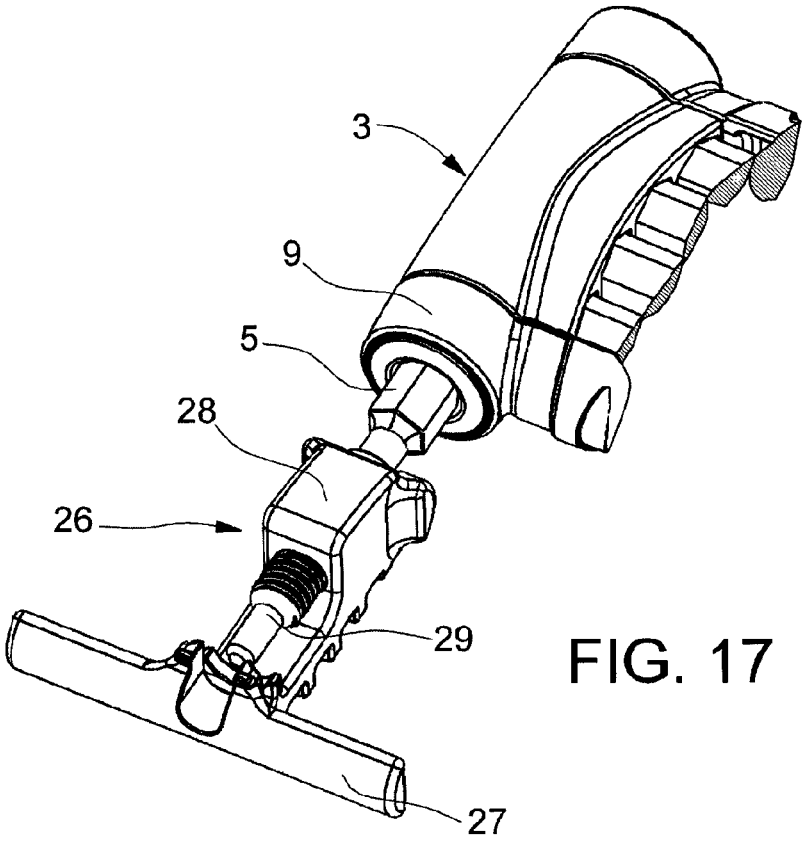
FIG. 17 is a detailed perspective view of the multiple tool with one implement driving the chain breaking implement in an operating position.

The chain breaker tool 26 has an handle 27 to prevent the body 28 from turning while turning the screw 29 with a tool bit 5 inserted in the driver means 6, as shown in FIG. 17.

The chain breaker tool 26 is elastically held inside the recesses 20 of the first elongated member 7 and of said second elongated member 8.

In use, when a specific implement 5 must be selected, the user rotates the corresponding holder 3 from the inactive position—FIG. 1—to the opened position, FIG. 2.

Figure 4:
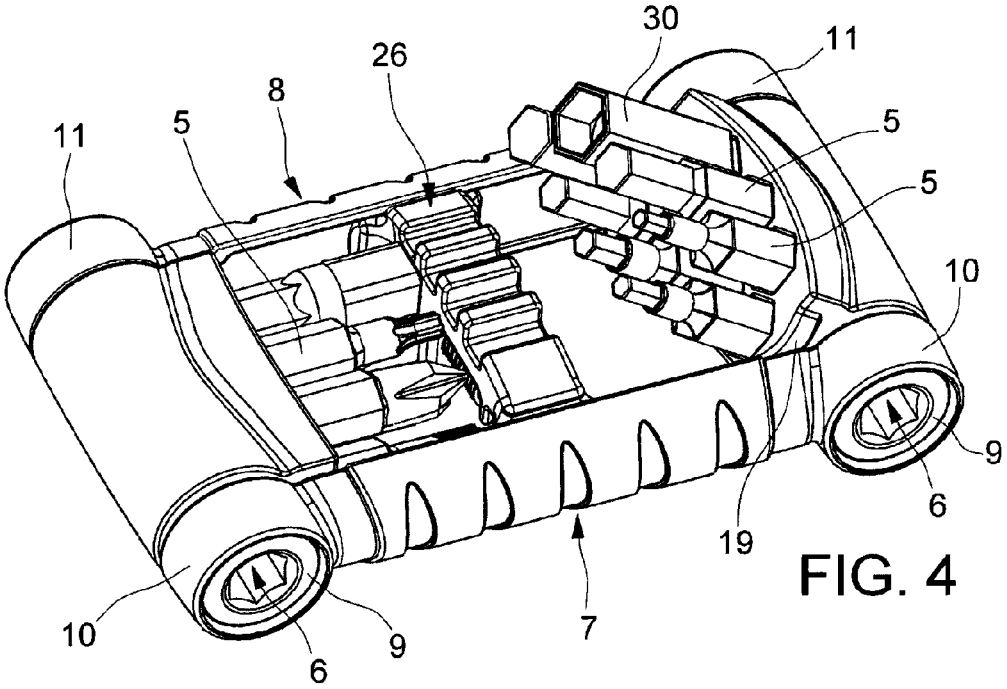
FIG. 4 is a perspective view of the multiple tool with an implement holder in the process of being closed.
Figure 5:
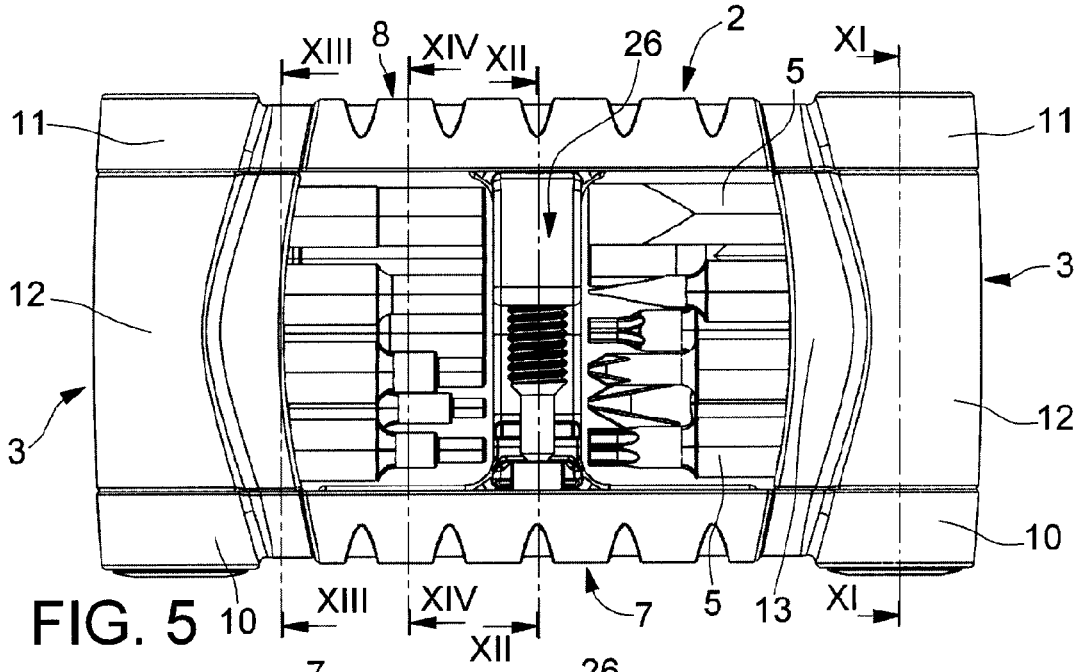
FIG. 5 is a top perspective view of the multiple tool.
Figure 6:
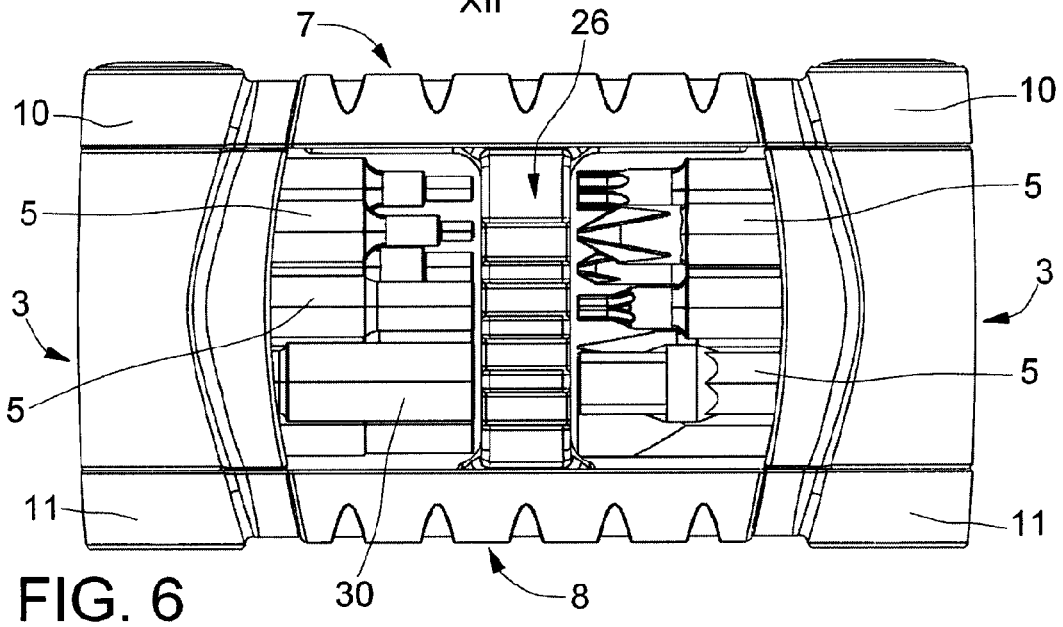
FIG. 6 is a bottom perspective view of the multiple tool.

In doing so, the bump 19 of the holder 3, as shown in FIG. 4, presses against the inner face 21 of the first elongated member 7, causing its outward translation, guided by the pivot elements 9.

Such outward translation is contrasted by the compression springs 22.

When the holder 3 has reached the opened position of FIG. 2 or FIG. 3, the first elongated member 7, forced by the compression springs 22, returns in the initial position.

In this situation, the holder 3 cannot rotate back to the inactive position, since the bump 19 rests on the outer cylindrical surface of the extremity 10 of the first elongated member 7: the user can therefore chose the implement 5 even using just one hand, since the holder 3 is firmly retained in the opened position. To rotate the holder 3 back in the inactive position, the user must exert a certain pressure in such a way that the bump 19 can force the first elongated member 7 to move outward, allowing the bump 19 itself to fit again back inside the recess 20.

Figure 15:
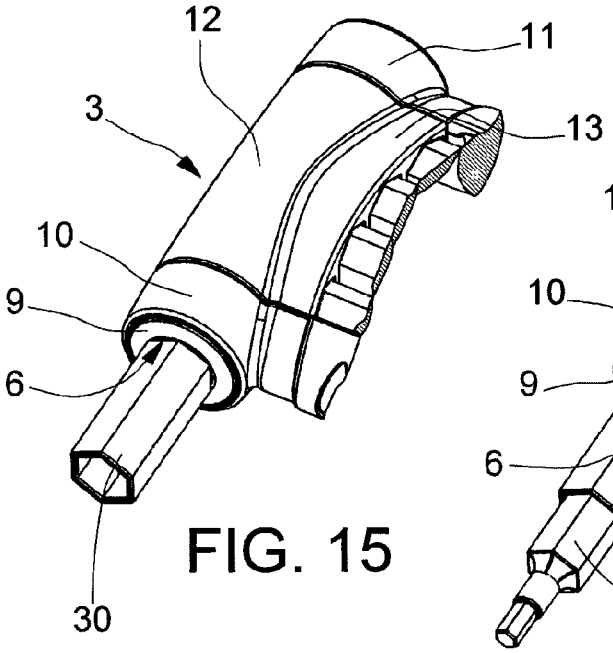
FIG. 15 is a detailed perspective view of the multiple tool with an extension implement in an operating position.
Figure 16:
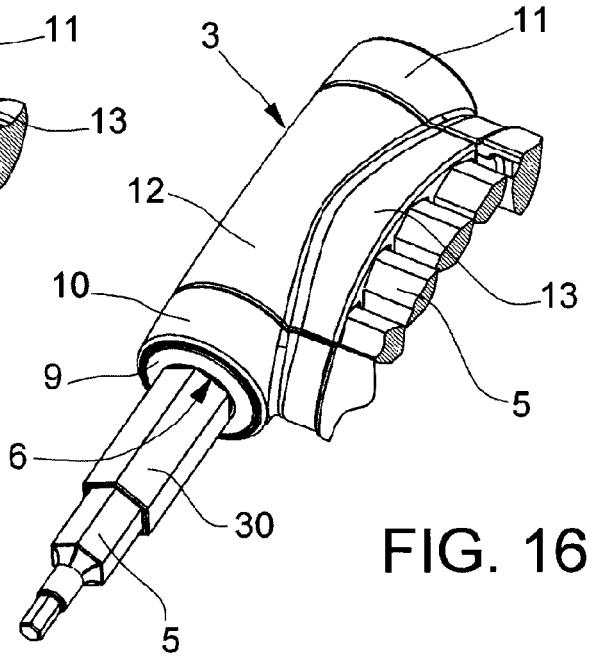
FIG. 16 is a detailed perspective view of the multiple tool with an implement installed into the extension implement shown in FIG. 15, and in an operating position.

To operate the selected implement 5, the user inserts it inside one of the hexagonal recesses 6, as shown in FIGS. 15,16,17. More in detail, in FIG. 15 is shown a tool bit extender 30 inserted in an hexagonal recess 6; in FIG. 16 is shown an implement 5 inserted in the tool bit extender 30; in FIG. 17 is shown the chain breaker tool 26 operated by a suitable implement 5 inserted in the hexagonal recess 6.

It can be seen that the invention reaches the proposed purposes.

First of all, a great number of different implements 5 can be stored inside the seats 4 of the holder 3, in a configuration of minimum encumbrance which is ideal for transporting, for example in a pocket, in a small bag, or the like.

Furthermore, all the multiple tool is totally customizable, since the implements 5 can be chosen and/or replaced by the user, without any limitation, selecting from a wide variety.

The holders 3 are retained elastically and firmly in the inactive position, and the implements 5 cannot get out in any way. As well, the holders 3 are firmly retained in the opened position, making the choice of the implements 5 easy and quick for the user.

Once the user has selected the suitable implement 5, the latter can be operated by the frame 2 of the multiple tool 1 itself—in particular by the driver means 6—providing a safe and comfortable grip for the user's hand.

Figure 18:
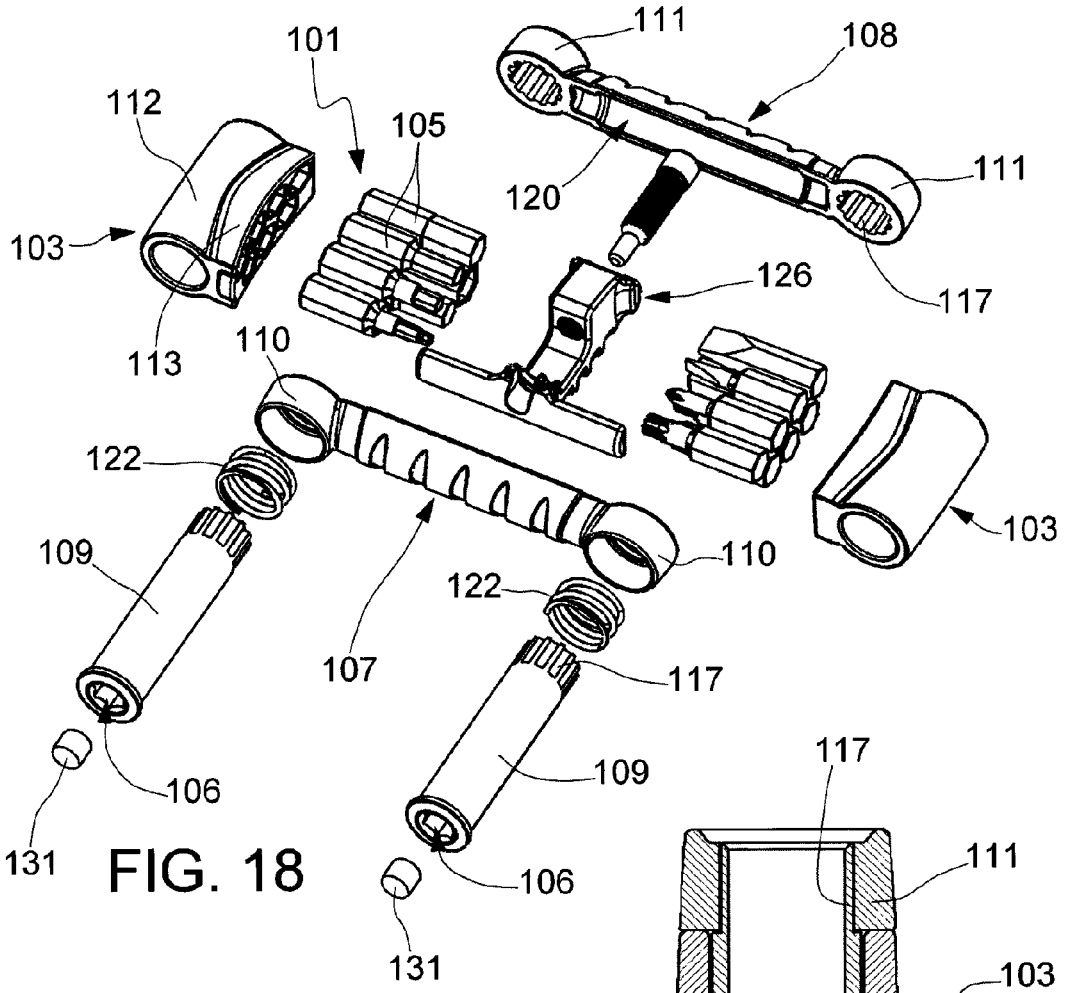
Figure 19:
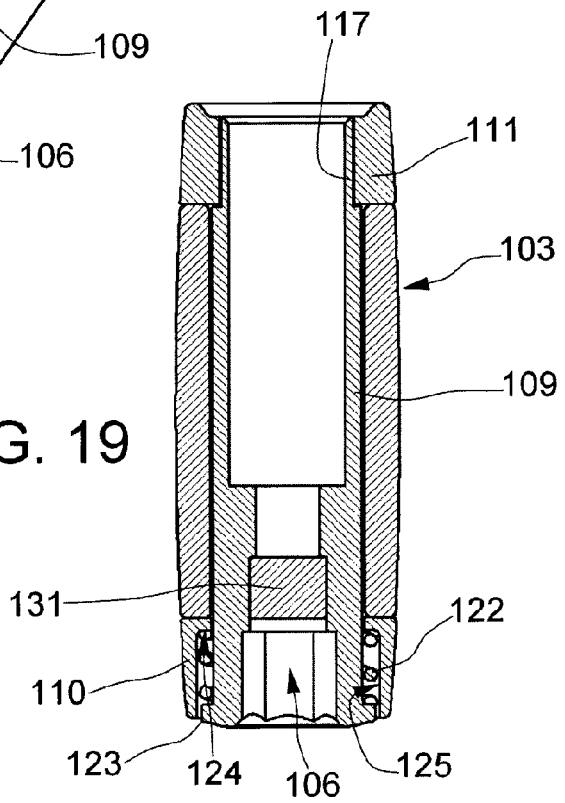
FIG. 19 is a section of the multiple tool of FIG. 18.

Another embodiment of the multiple tool 101 according to the present invention is represented in FIGS. 18,19. In this embodiment, the parts that correspond to those of the preceding embodiment are indicated with the same reference numbers, increased by 100 unities. FIG. 18 shows, an exploded view of the multiple tool 101 of the present embodiment, which is identical to the one described in the former embodiment of FIG. 1-17.

In this embodiment, the multiple tool 101 comprises at least a magnet 131 for the retention of the implements 105 inside the hexagonal recess 106.

In this way, the implement 105 is prevented from accidentally get out of the hexagonal recess 106.

More in detail, the multiple tool 101 comprises two magnets 131 provided inside the hexagonal recess 106. As shown in FIG. 19, each magnet 131 is inserted inside the cavity of each pivot element 109, very close to the respective hexagonal recess 106.

Figure 20:
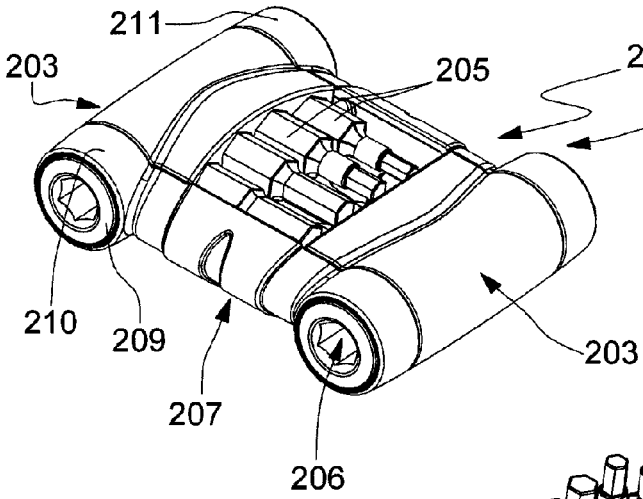
FIG. 20 is a perspective view of a further embodiment of the multiple tool according to the invention.
Figure 21:
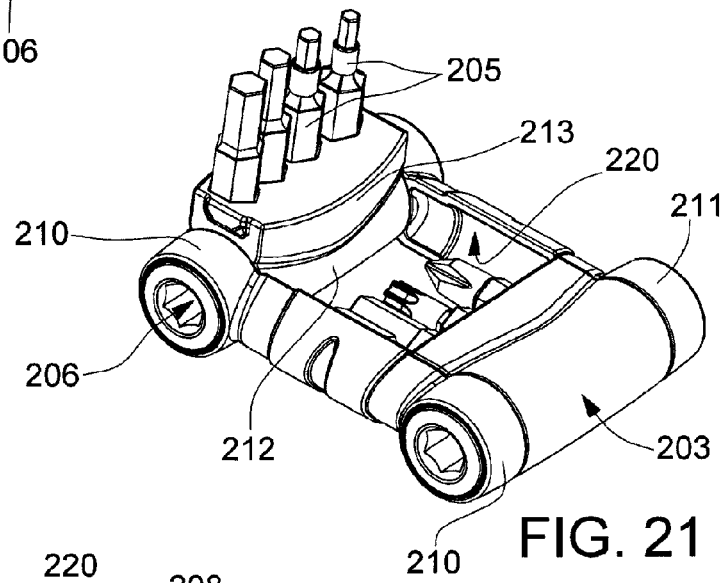
FIG. 21 is a perspective view of the multiple tool shown in FIG. 20 with one implement holder open for selection of an implement.
Figure 22:
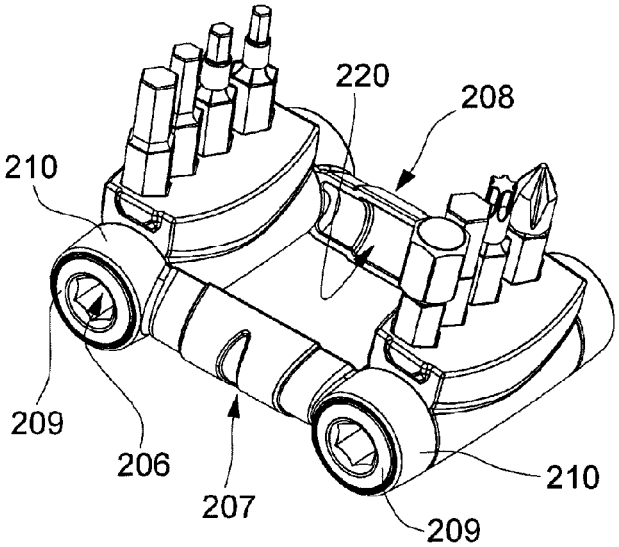
FIG. 22 is a perspective view of the multiple tool shown in FIG. 20 with both implement holders open for selection of an implement.
Figure 23:
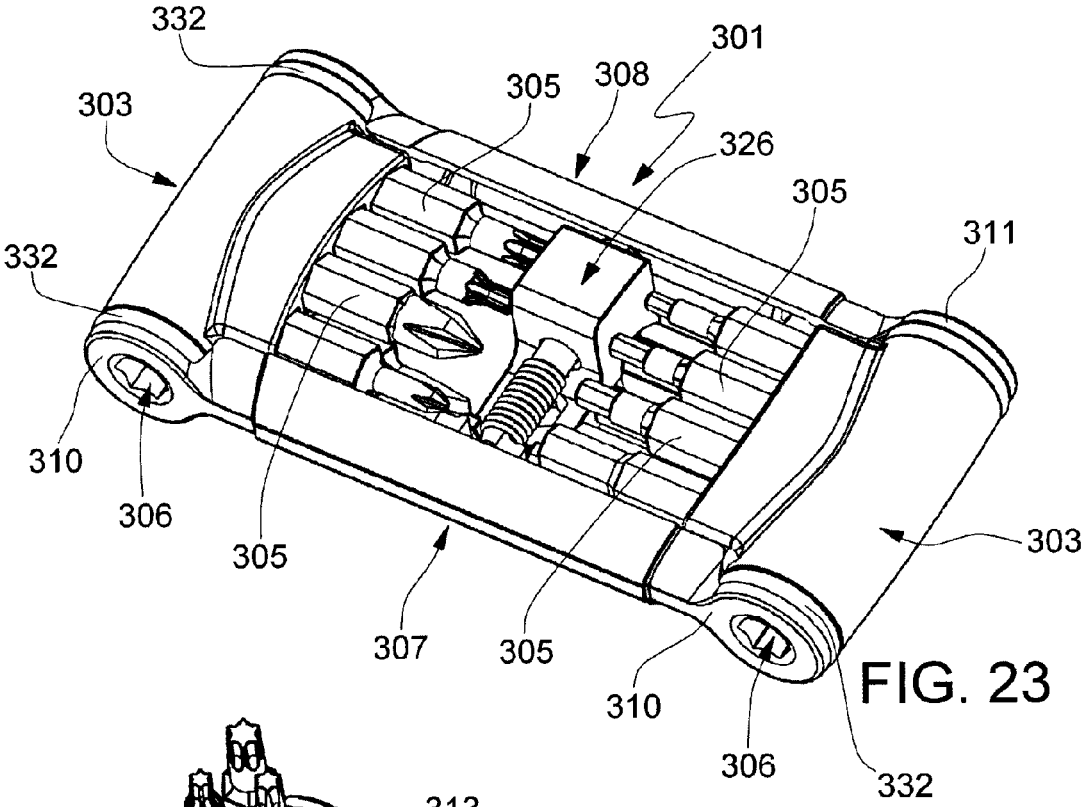
FIG. 23 is a perspective view of yet another embodiment of the multiple tool according to the present invention.
Figure 24:
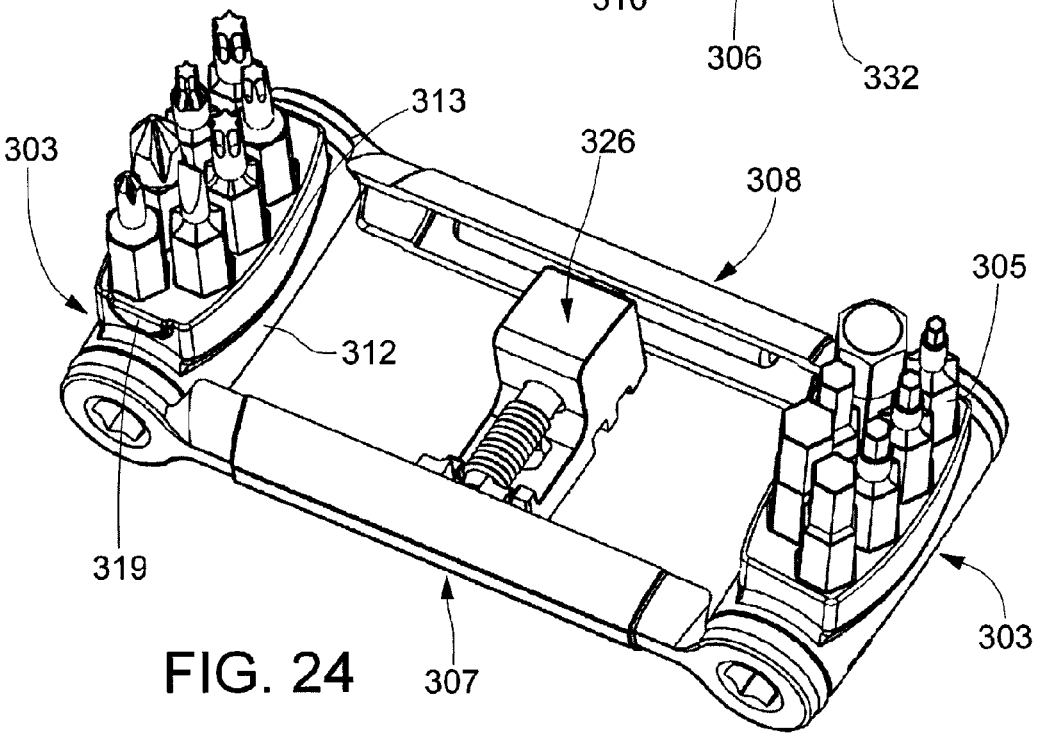
FIG. 24 is a perspective view of the multiple tool of FIG. 23 with both implement holders open for selection of an implement.

Another embodiment of the multiple tool 201 according to the present invention is shown in FIGS. 20-22. In this embodiment, the parts that correspond to those of the preceding embodiment are indicated with the same reference numbers, increased by 100 unities.

This embodiment is identical to the one of FIGS. 1-17, except for the fact that it lacks the chain breaker tool.

Consequently, the first and second elongated members 207,208 are shorter than those of the embodiment of FIGS. 1-17: the multiple tool 201 is then lighter, more practical and convenient to use and transport. Still another embodiment of the multiple tool 301 according to the present invention is shown in FIGS. 23-32. In this embodiment, the parts that correspond to those of the preceding embodiments are indicated with the same reference numbers, increased by 100 unities. This embodiment is generally less expensive than the previous ones.

This embodiment of the multiple tool 301 incorporates a different kind of elastic retention means 318, which provide several advantages in terms of costs, as it will be clarified hereafter.

In this embodiment, the first and second elongated members 307,308 are preferably stamped: stamping will generally produce a less expensive component than forging or casting.

Figure 25:
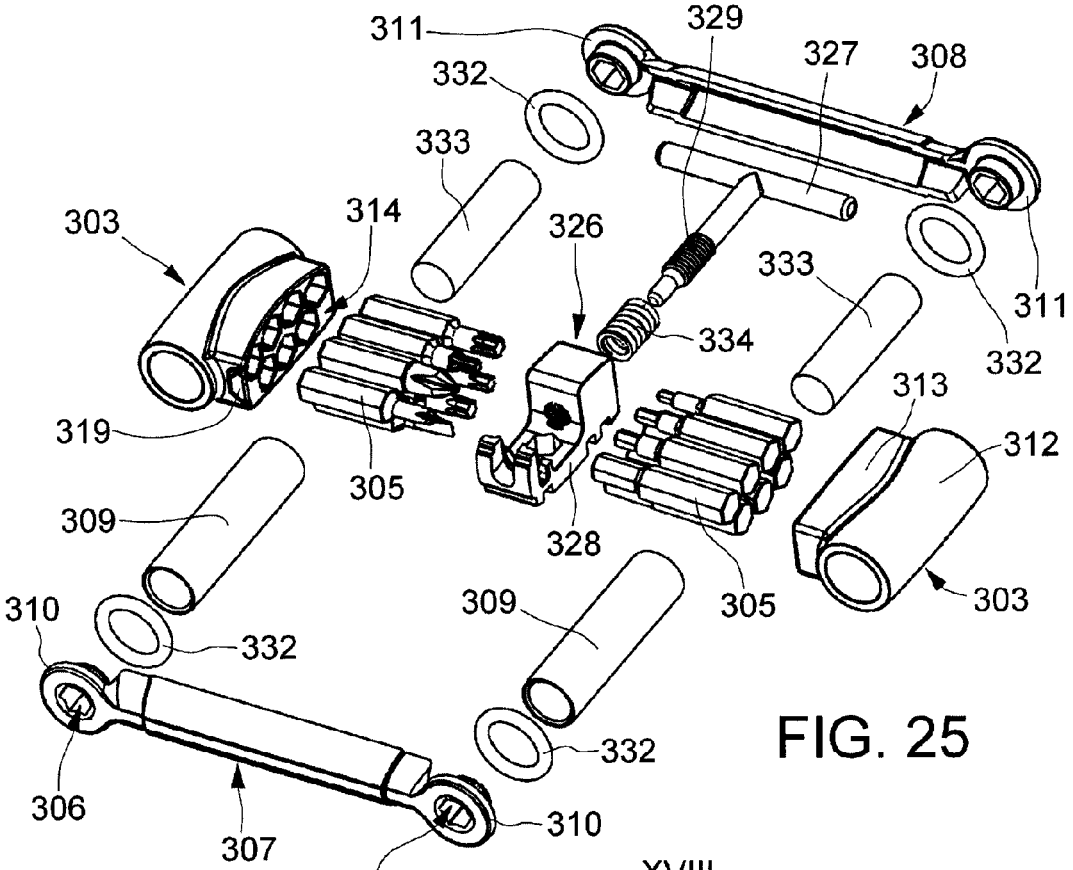
FIG. 25 is an exploded perspective view of the multiple tool of FIG. 23.
Figure 26:
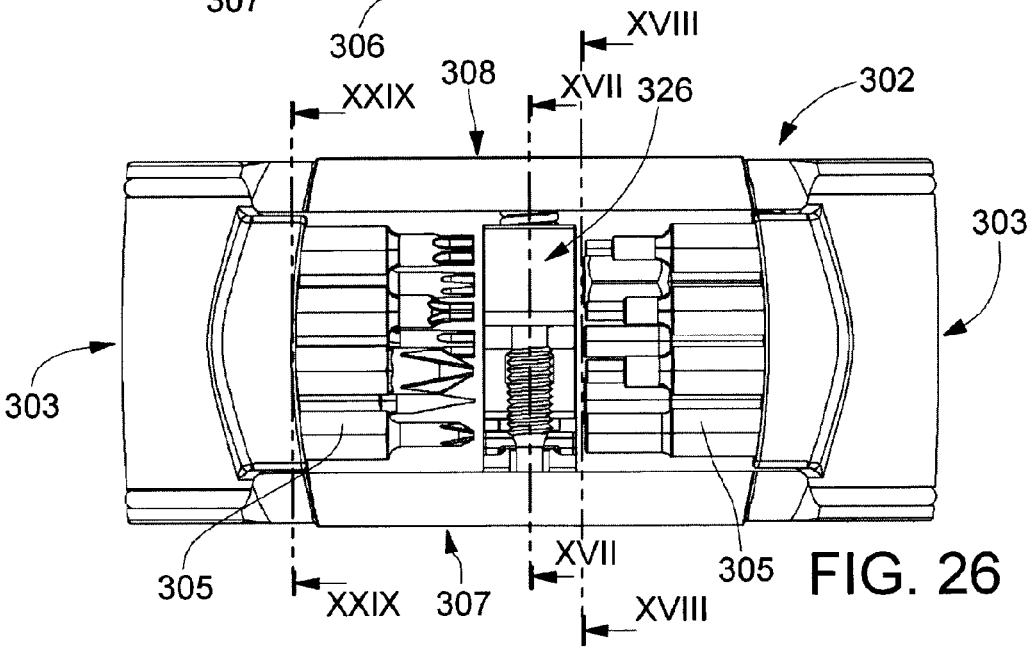
FIG. 26 is a top perspective view of the multiple tool of FIG. 23.
Figure 30:
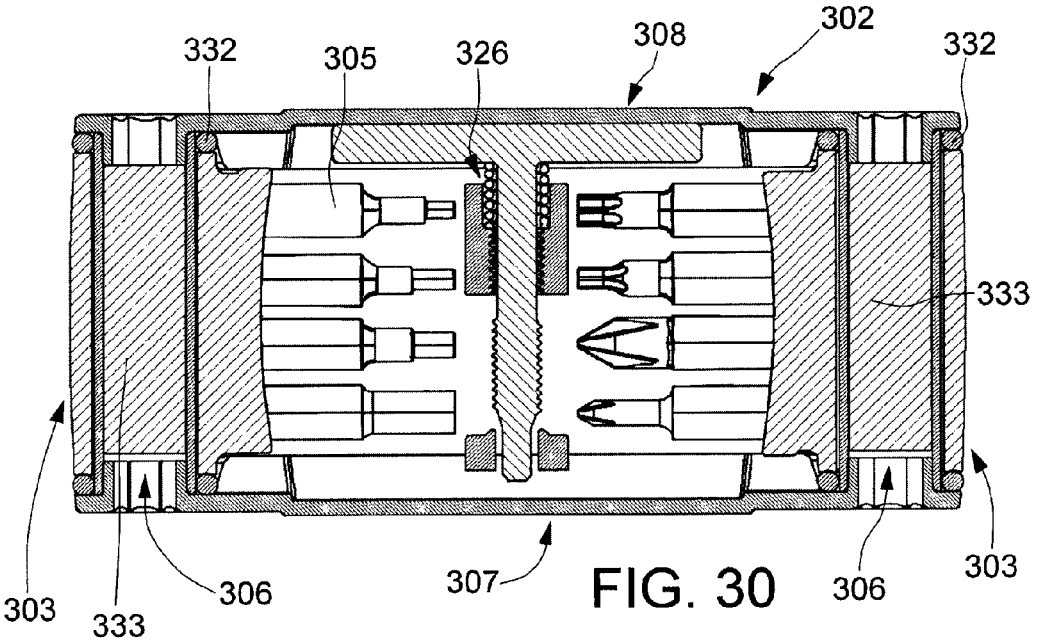
FIG. 30 is a section of the multiple tool of FIG. 23.

The first and second elongated members 307,308 have their extremities 310,311 provided with respective hexagonal recesses 306, as shown for example in FIGS. 25,30: thanks to this feature, the multiple tool 301 can hold up to four implements 305 or tool bits simultaneously.

Figure 31:
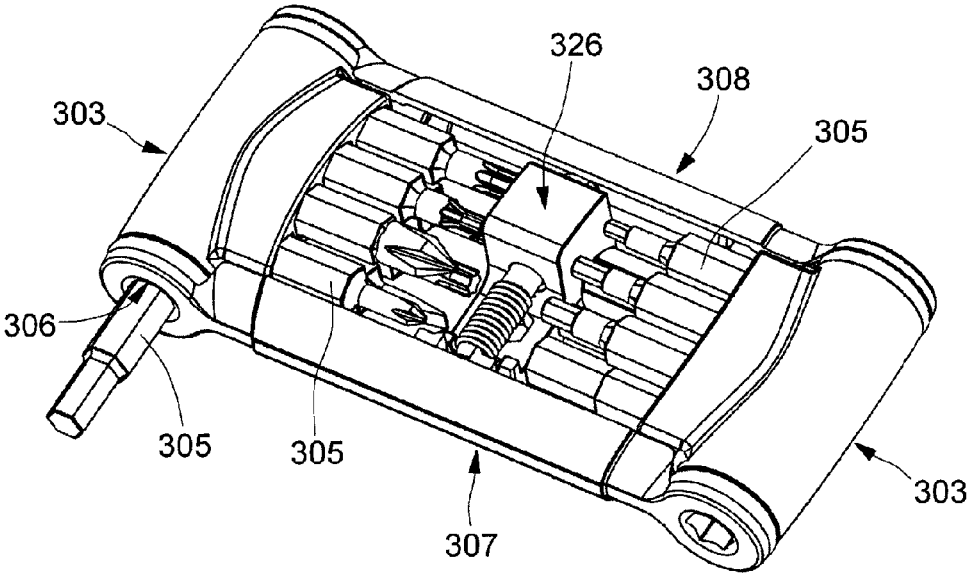
FIG. 31 is a perspective view of the multiple tool of FIG. 23 with one of the implements in an operating position.

In FIG. 31 the multiple tool 301 is shown with just one implement 305 inserted. It is clear that other implements 305 can be inserted in the other three hexagonal recesses 306.

The pivot elements 309 have both their respective first and second ends 315,316 rigidly connected to the respective extremities 310,311 of the first elongated member 307 and of said second elongated member 308, as shown in FIG. 30.

Each pivot element 309 is constituted by a simple cylinder, which is less expensive than a machined and broached pivot element.

The elastic retention means 318 comprise, for each of the holders 303, at least an O-ring 332 inserted along the respective pivot element 309 and resting between the holder 303 and the inner face 321 of the first elongated member 307 or second elongated member 308. More in detail, the elastic retention means 318 comprise, for each of the holders 303, two opposed O-rings 332 inserted along the respective pivot element 309, resting between the holders 303 and the inner faces 321 of the first elongated member 307 and the second elongated member 308.

When each holder 303 is in its inactive position, each O-ring 332 rest between the bump 319 of the respective holder 303 and the inner face 321 of said first elongated member 307 or second elongated member 308. In this way, each O-ring 332 is axially compressed, and provides elastic retention of the respective holder 303 in the inactive position.

The presence of O-rings 332, besides providing a solution which is cheaper than that comprising compression springs, also provides a barrier against contamination.

In the multiple tool 301 according to the present embodiment, each of the holders 303 comprise retention means 333 for the implements 305.

For each holder 303, such retention means 333 are constituted by a magnet inserted inside the cavity of the respective pivot element 309.

As shown in FIGS. 25,30 the magnet 333 is sufficiently long to hold the implements 305 inside the respective seats 304 of the holder 303 and to hold the selected implement 305 inside the hexagonal recess 306. The chain breaker tool 326 of the present embodiment is spring loaded, in order to be retained between the first and second elongated members 307,308 which in this embodiment are not spring loaded.

To this purpose, the chain breaker tool 326 comprises an handle 327 which is screwed in the chain breaker body 328.

Figure 27:
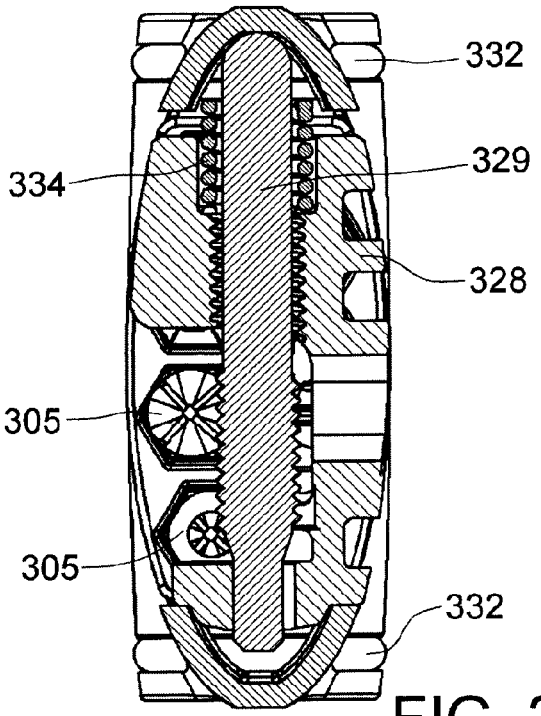
FIG. 27 is a section of the multiple tool according to plane XXVII-XXVII of FIG. 26.
Figure 28:
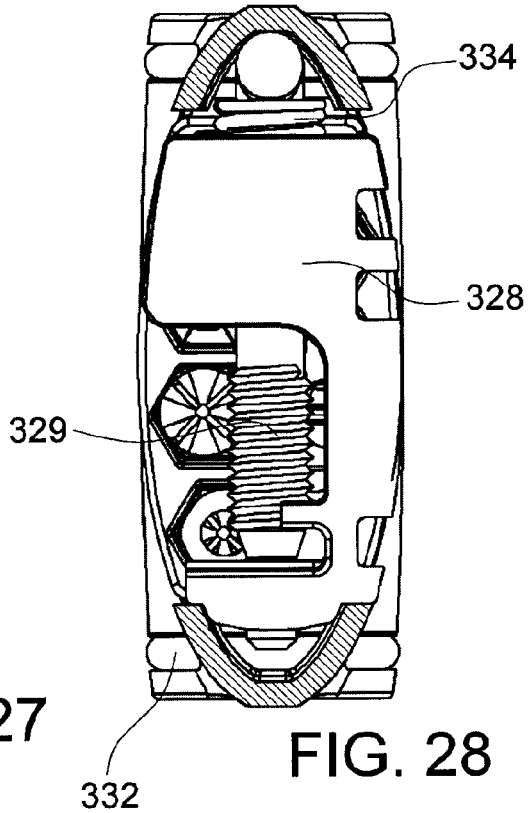
FIG. 28 is a section of the multiple tool according to plane XXVIII-XXVIII of FIG. 26.
Figure 29:
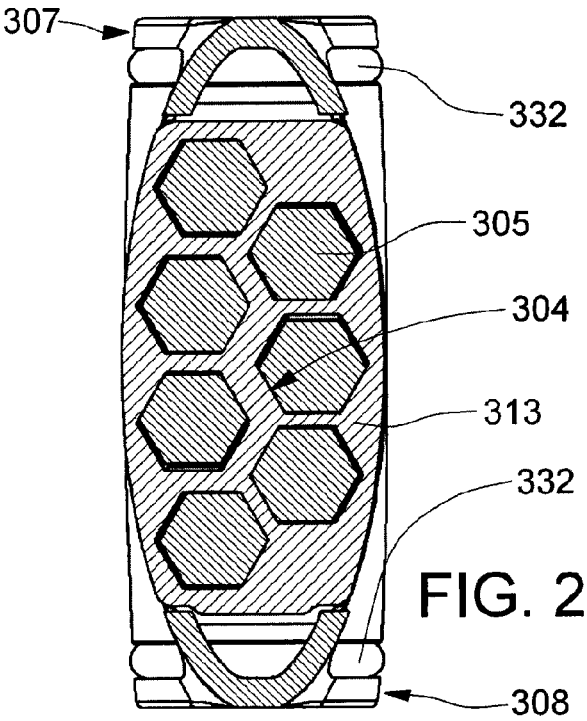
FIG. 29 is a section of the multiple tool according to plane XXIX-XXIX of FIG. 26.

A loading spring 334 is inserted along the screw 329 of the handle 327, see for example FIGS. 27,28. The handle 327 becomes spring loaded when the screw 329 is turned in far enough that the threads disengage from the threads of the body 328.

Figure 32:
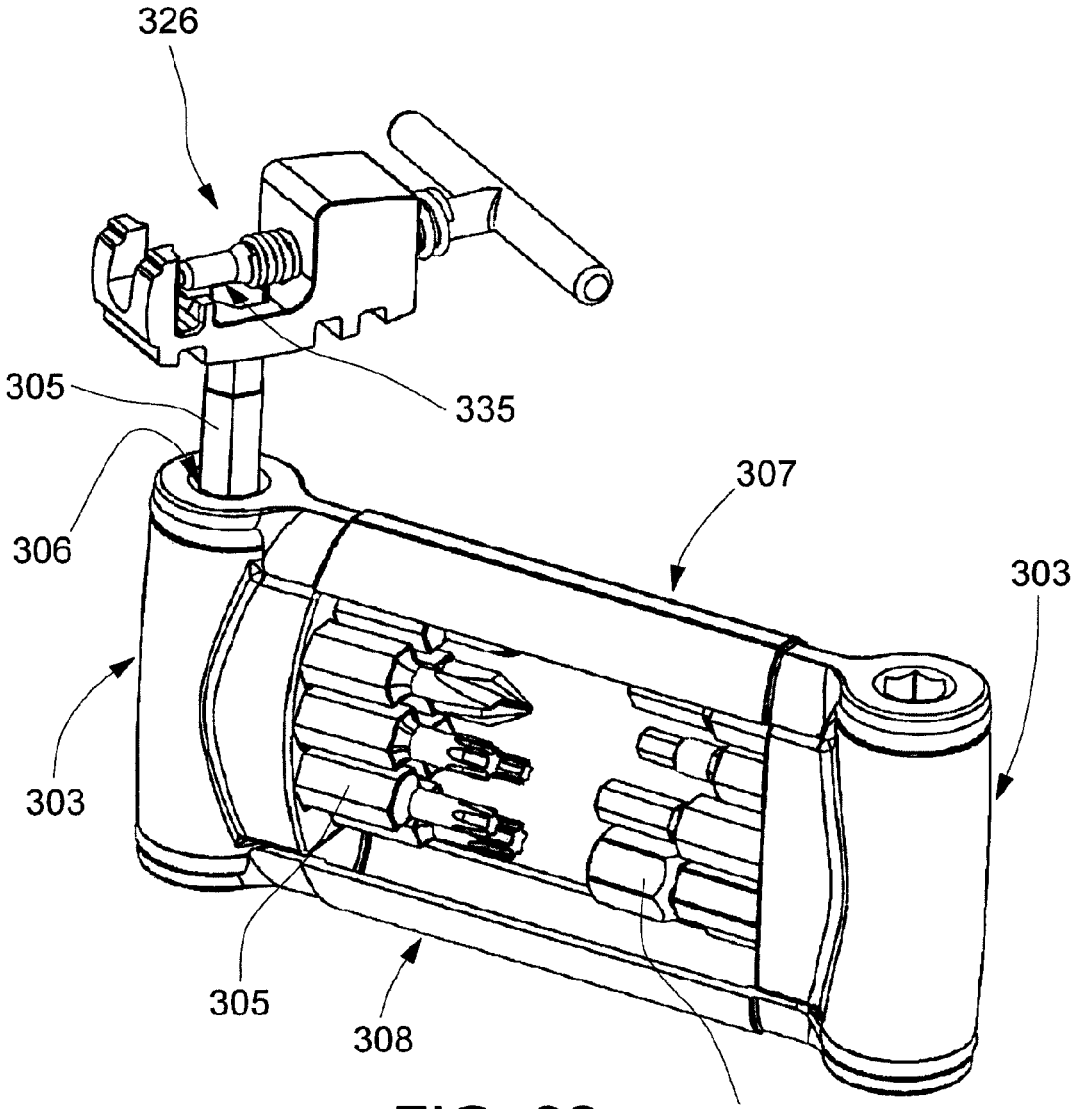
FIG. 32 is a perspective view of the multiple tool of FIG. 23 with one implement driving the chain breaking implement in an operating position.

The chain breaker tool 326 comprises an hexagonal seat 335 for an implement 305 which may in turn be selectively inserted in one of the hexagonal recesses 306 of the first elongated body 307 or of the second elongated body 308, for operation of the chain breaker tool 326, as shown in FIG. 32.

As described, this embodiment of the multiple tool 301 provides several advantages in terms of cost, is lighter and can hold up to four implements 305 simultaneously.

In other embodiments, not shown, different kinds of elastomeric springs, or combinations of coil springs and elastomeric springs may be used, in order to achieve the best solution for the specific application. In further other embodiments, not shown, the multiple tool may comprise, for each pivot element, a couple of holders, placed side by side, each having a respective bump fitting inside the respective recess of the inner face of said first elongated member or of said second elongated member.

In this way, an even more customizable and versatile multiple tool can be obtained.

The present invention has been described according to preferred embodiments, but equivalent variants can be devised without departing from the scope of protection offered by the following claims.

The invention claimed is:

1. A multiple tool comprising:

a first implement holder having a cylindrical opening and a plurality of seats on a radially extending portion from the cylindrical opening and configured for receiving a plurality of implements;

a second implement holder opposite the first implement holder having a cylindrical opening and a plurality of seats on a radially extending portion from the cylindrical opening and configured for receiving a plurality of implements;

a first elongated member coupled to a first end of the first implement holder and to a first end of the second implement holder;

a second elongated member opposite the first elongated member and coupled to a second end of the first implement holder and to a second end of the second implement holder;

a first pivot element within the cylindrical opening of the first implement holder and having a first end rigidly connected to a first end of the second elongated member, the first pivot element enabling the first implement holder to be selectively rotatable around the first pivot element from an inactive position of minimum encumbrance to at least an opened position for a selection of an implement from the plurality of implements;

a first circular opening located at a first end of the first elongated member and a first non-circular recess located at a second end of the first pivot element for receiving and operating a selected implement, wherein the first non-circular recess is positioned within the first circular opening;

a second pivot element within the cylindrical opening of the second implement holder and having a first end rigidly connected to a second end of the second elongated member, the second pivot element enabling the second implement holder to be selectively rotatable around the second pivot element from an inactive position of minimum encumbrance to at least an opened position for a selection of an implement from the plurality of implements; and a second circular opening located at a second end of the first elongated member and a second non-circular recess located at a second end of the second pivot element for receiving and operating a selected implement, wherein the second non-circular recess is positioned within the second circular opening.

2. The multiple tool of claim 1, wherein the first pivot element is coupled between the first and second elongated members.

3. The multiple tool of claim 1, further comprising a cylindrical magnet disposed within the cylindrical opening of the first implement holder.

4. The multiple tool of claim 3, wherein the cylindrical magnet is disposed within the first pivot element.

5. The multiple tool of claim 1, wherein at least one of the implements is a hexagonal driven standardized tool bit and wherein the non-circular recess is a hexagonal recess.

6. The multiple tool of claim 5, further comprising a magnet disposed within the hexagonal recess.

7. The multiple tool of claim 1, wherein the first implement holder further comprises a bump configured to abut against an outer surface of the first elongated member in the opened position and be disposed within an inner surface of the first elongated member in the inactive position.

8. The multiple tool of claim 1, further comprising an elastic retention means between the first implement holder and the first elongated member.

9. The multiple tool of claim 8, wherein the elastic retention means comprises a compression spring or an O-ring.

10. The multiple tool of claim 1, wherein the second end of the first pivot element comprises splines that engage with splines on the second elongated member defining said rigid connection.

11. The multiple tool of claim 1, further comprising a chain breaker tool coupled to either the first or the second elongated member and between the first and the second elongated members.

12. The multiple tool of claim 11, wherein the chain breaker tool is detachably coupled within a recess of an inner surface of the first or the second elongated member.

13. The multiple tool of claim 11, wherein the chain breaker tool is positioned between the first implement holder and the second implement holder.

14. A multiple tool comprising:

a first implement holder having a cylindrical opening and a plurality of seats on a radially extending portion from the cylindrical opening and configured for receiving a plurality of implements;

a second implement holder opposite the first implement holder having a cylindrical opening and a plurality of seats on a radially extending portion from the cylindrical opening and configured for receiving a plurality of implements;

a first elongated member coupled to a first end of the first implement holder and to a first end of the second implement holder and having a circular opening at a first end and a second end;

a second elongated member opposite the first elongated member and coupled to a second end of the first implement holder and to a second end of the second implement holder having splines at both a first end and a second end;

a first pivot element within the cylindrical opening of the first implement holder and the circular opening at the first end of the first elongated member and having splines at a first end configured to engage the splines at the first end of the second elongated element and a non-circular opening for receiving and operating a selected implement at a second end, the first pivot element enabling the first implement holder to be selectively rotatable around the first pivot element from an inactive position of minimum encumbrance to at least an opened position for a selection of an implement from the plurality of implements; and a second pivot element within the cylindrical opening of the second implement holder and the circular opening at the second end of the first elongated member and having splines at a first end configured to engage the splines at the second end of the second elongated element and a non-circular opening for receiving and operating a selected implement at a second end, the second pivot element enabling the second implement holder to be selectively rotatable around the second pivot element from an inactive position of minimum encumbrance to at least an opened position for a selection of an implement from the plurality of implements.

15. The multiple tool of claim 14, wherein the non-circular openings of the first and second pivot elements are hexagonal and the plurality of seats on the first and second implement holders are hexagonal.

16. A multiple tool comprising:

a first implement holder having a cylindrical opening and a plurality of seats on a radially extending portion from the cylindrical opening and configured for receiving a plurality of implements;

a second implement holder opposite the first implement holder having a cylindrical opening and a plurality of seats on a radially extending portion from the cylindrical opening and configured for receiving a plurality of implements;

a first elongated member coupled to a first end of the first implement holder and to a first end of the second implement holder and having a non-circular opening at a first end of the first elongated member for receiving and operating a selected implement and a non-circular opening at a second end of the first elongated member for receiving and operating a selected implement;

a second elongated member opposite the first elongated member and coupled to a second end of the first implement holder and to a second end of the second implement holder and having a non-circular opening at a first end of the second elongated member for receiving and operating a selected implement and a non-circular opening at a second end of the second elongated member for receiving and operating a selected implement;

a first pivot element within the cylindrical opening of the first implement holder enabling the first implement holder to be selectively rotatable from an inactive position of minimum encumbrance to at least an opened position for a selection of an implement from the plurality of implements; and a second pivot element within the cylindrical opening of the second implement holder enabling the second implement holder to be selectively rotatable from an inactive position of minimum encumbrance to at least an opened position for a selection of an implement from the plurality of implements.

17. The multiple tool of claim 16, further comprising a cylindrical magnet disposed within the cylindrical opening of the first implement holder and a cylindrical magnet disposed within the cylindrical opening of the second implement holder.

* * * * *